US011447960B2

(12) United States Patent
Batten et al.

(10) Patent No.: US 11,447,960 B2
(45) Date of Patent: Sep. 20, 2022

(54) WALL PANEL SYSTEM

(71) Applicants: Andrew J. Batten, Pleasant Ridge, MI (US); Dale W. Batten, Harrison Township, MI (US)

(72) Inventors: Andrew J. Batten, Pleasant Ridge, MI (US); Dale W. Batten, Harrison Township, MI (US)

( * ) Notice: Subject to any disclaimer, the term of this patent is extended or adjusted under 35 U.S.C. 154(b) by 3 days.

(21) Appl. No.: 17/022,452

(22) Filed: Sep. 16, 2020

(65) Prior Publication Data

US 2021/0087826 A1 Mar. 25, 2021

Related U.S. Application Data

(60) Provisional application No. 62/902,650, filed on Sep. 19, 2019.

(51) Int. Cl.

| | |
|---|---|
| ***E04F 13/09*** | (2006.01) |
| ***E04F 13/08*** | (2006.01) |
| ***E04B 2/02*** | (2006.01) |
| ***E04B 2/72*** | (2006.01) |

(52) U.S. Cl.

CPC ..... *E04F 13/09* (2013.01); *E04B 2/02* (2013.01); *E04B 2/723* (2013.01); *E04F 13/0801* (2013.01); *E04F 13/0866* (2013.01); *E04B 2002/0243* (2013.01); *E04B 2002/0286* (2013.01)

(58) Field of Classification Search

CPC ... E04F 13/09; E04F 13/0801; E04F 13/0835; E04B 2/02; E04B 2002/0243; E04B 2002/7462; E04B 2/723; E04B 2002/0286; F16B 21/073; F16B 21/075; F16B 35/048; F16B 12/10; F16B 12/24

USPC ..... 52/483.1, 506.04, 511

See application file for complete search history.

(56) References Cited

U.S. PATENT DOCUMENTS

| | | | | | |
|---|---|---|---|---|---|
| 1,419,652 | A * | 6/1922 | Turner | F16B 12/24 | 411/371.2 |
| 1,925,331 | A * | 9/1933 | Maag | E04C 2/28 | 52/483.1 |
| 2,255,367 | A * | 9/1941 | Schenk | E04B 2/7457 | 52/578 |
| 3,056,234 | A * | 10/1962 | Nels | F16B 35/048 | 52/363 |
| 3,071,217 | A * | 1/1963 | Gould | B64C 1/40 | 244/119 |
| 3,337,925 | A * | 8/1967 | Meyer | F16B 5/128 | 52/716.6 |
| 3,916,756 | A * | 11/1975 | Yoda | F16B 21/075 | 24/683 |
| 4,408,372 | A * | 10/1983 | Kimura | F16B 21/073 | 411/61 |
| 4,472,918 | A * | 9/1984 | Mach | F16B 5/0657 | 24/672 |
| 4,684,286 | A * | 8/1987 | Itagaki | F16B 9/052 | 403/372 |

(Continued)

*Primary Examiner* — Brian E Glessner
*Assistant Examiner* — Adam G Barlow
(74) *Attorney, Agent, or Firm* — The Dobrusin Law Firm, P.C.; Bryan S. Lemanski

(57) ABSTRACT

A wall system comprising a frame and one or more panels removably attached to the frame, wherein the one or more panels are positioned over one or more cutouts of the frame to form a substantially coplanar surface.

18 Claims, 5 Drawing Sheets

(56) References Cited

U.S. PATENT DOCUMENTS

| | | | | |
|---|---|---|---|---|
| 5,257,490 | A * | 11/1993 | Endo | E04F 13/0835 52/746.1 |
| 5,542,225 | A * | 8/1996 | Endo | F16B 21/078 52/704 |
| 6,629,335 | B1 * | 10/2003 | Derman | E05F 5/06 292/DIG. 60 |
| 7,568,318 | B1 * | 8/2009 | Egan | E04C 2/296 52/309.7 |
| 7,788,860 | B2 * | 9/2010 | Bartman | E04F 13/0814 52/506.05 |
| 8,251,626 | B1 * | 8/2012 | Gonzalez | F16B 21/086 411/509 |
| 8,776,326 | B2 * | 7/2014 | Clarke | F16B 21/186 24/297 |
| 9,068,358 | B2 | 6/2015 | MacDonald et al. | |
| 9,394,703 | B2 * | 7/2016 | Schaefer | E04F 13/083 |
| 9,458,868 | B2 * | 10/2016 | Metten | F16B 21/078 |
| 2002/0006320 | A1 * | 1/2002 | Kupper | F16B 35/041 411/383 |
| 2003/0208978 | A1 * | 11/2003 | Chen | E04F 13/0862 52/489.1 |
| 2007/0160418 | A1 * | 7/2007 | Lo | F16B 19/00 403/275 |
| 2011/0042541 | A1 * | 2/2011 | Spencer | B43L 1/00 29/428 |
| 2011/0083390 | A1 * | 4/2011 | Bui | E04C 2/384 411/501 |
| 2017/0035197 | A1 * | 2/2017 | Franco | E04H 3/10 |
| 2019/0127976 | A1 * | 5/2019 | Donnelly | E02B 3/10 |
| 2021/0207382 | A1 * | 7/2021 | Nielsen | E04F 13/12 |

* cited by examiner

WALL PANEL SYSTEM

FIELD

The present teachings generally relate to a wall system, and more specifically, to a customizable and interchangeable wall panel system.

BACKGROUND

Various commercial and consumer industries such as the construction and aeronautical industries require frequent alteration of finished structures. For example, the commercial construction industry is often required to update and remodel commercial building interiors to meet everchanging customer demands. The interior remodeling may require replacement or modification of a variety of items, including but not limited to: flooring, paneling, ceilings, countertops, walling, or a combination thereof. As a result, workers may be required to demolish existing interiors and replace the interiors with updated and more modern materials. However, demolition and full replacement of interiors is frequently costly and time-consuming.

As a result, many industries are inclined to use paneling materials that can be placed directly over existing interiors, thereby eliminating the need for demolition. However, these paneling materials are often not as durable or do not provide a proper finished look when compared to the original finished look of the interior. Additionally, while the paneling materials may often eliminate the initial need to demolish existing interiors, they generally do not allow for easy removal after being installed, thereby causing increased demolition and replacement costs in the future for any businesses that require frequent remodeling.

Examples of paneling systems are disclosed in U.S. Pat. Nos. 7,568,318 and 9,068,358, both of which are incorporated by reference herein for all purposes. It would be attractive to have a paneling system that may be easily installed onto existing walls or surfaces. What is needed is a paneling system that may be mounted directly onto walls or ceiling via fasteners, adhesives, or both. It would be attractive to have a customizable paneling system. What is needed is a paneling system having removable and interchangeable panels. It would be attractive to have a paneling system that minimizes installation costs. What is needed is a paneling system that does not require secondary operations, such as painting, staining, laminating, or a combination thereof to create a finished surface.

SUMMARY

The present teachings meet one or more of the present needs by providing a wall system comprising a frame and one or more panels removably attached to the frame, wherein the one or more panels are positioned over one or more cutouts of the frame to form a substantially coplanar surface.

The present teachings meet one or more of the present needs by providing a method of securing a wall system to a wall comprising: (i) placing one or more shims between the wall and the frame to create a desired gap between the wall and the frame; (ii) mounting the frame to the wall and the one or more shims via one or more fasteners, adhesives, or both; (iii) aligning a plurality of studs extending from the frame with a plurality of associated holes on the abutting surface of the one or more panels; and (iv) inserting the plurality of studs into the plurality of holes to secure the one or more panels to the frame so that the abutting surface abuts a surface of the frame.

The present teachings meet one or more of the present needs by providing a wall system, wherein: a perimeter of the one or more panels is greater than a perimeter of the one or more cutouts so that the one or more panels completely cover the one or more cutouts; each of the one or more panels includes at least one hole along an abutting surface that receives at least one stud projecting from a surface of the frame; the abutting surface of the one or more panels abuts the surface of the frame; a clip is at least partially inserted into the at least one hole and engages the at least one stud to secure the one or more panels to the frame; the frame is mounted to a wall by one or more fasteners, adhesives, or both; the frame is substantially coplanar with a baseboard secured to the wall; the one or more panels are coplanar with a base tile secured to the baseboard; the one or more panels are a medium-density fiberboard; the one or more panels include one or more exposed laminated surfaces to form a finished surface for the wall; the one or more panels are interchangeable; the one or more panels is a plurality of panels, and an exposed surface of the plurality of panels create a substantially uniform surface finish; the frame is a medium-density fiberboard; once the one or more panels are attached to the frame, the one or more panels abut one another, are spaced apart by a desired width, or both; the wall is a gypsum board; the one or more panels are interchangeable free of any distortion or damage to the one or more panels; the one or more panels are between 10 to 15 mm thick; the frame is between 10 to 15 mm thick; the at least one stud is inserted into the clip by a force of about 10 pounds, and is released by clip by a force of about 25 pounds; or a combination thereof. Additionally, the clip may include a base portion inserted into the at least one hole and an inner clip threaded into the base portion, and wherein the at least one stud is inserted into the inner clip The present teaching meet one or more of the present needs by providing a paneling system that: may be easily installed onto existing walls or surfaces; may be mounted directly onto walls or ceiling via fasteners, adhesives, or both; is a customizable paneling system; includes removable and interchangeable panels; minimizes installation costs; does not require secondary operations, such as painting, staining, laminating, or a combination thereof; or a combination thereof to create a finished surface.

DETAILED DESCRIPTION

Figure 1:
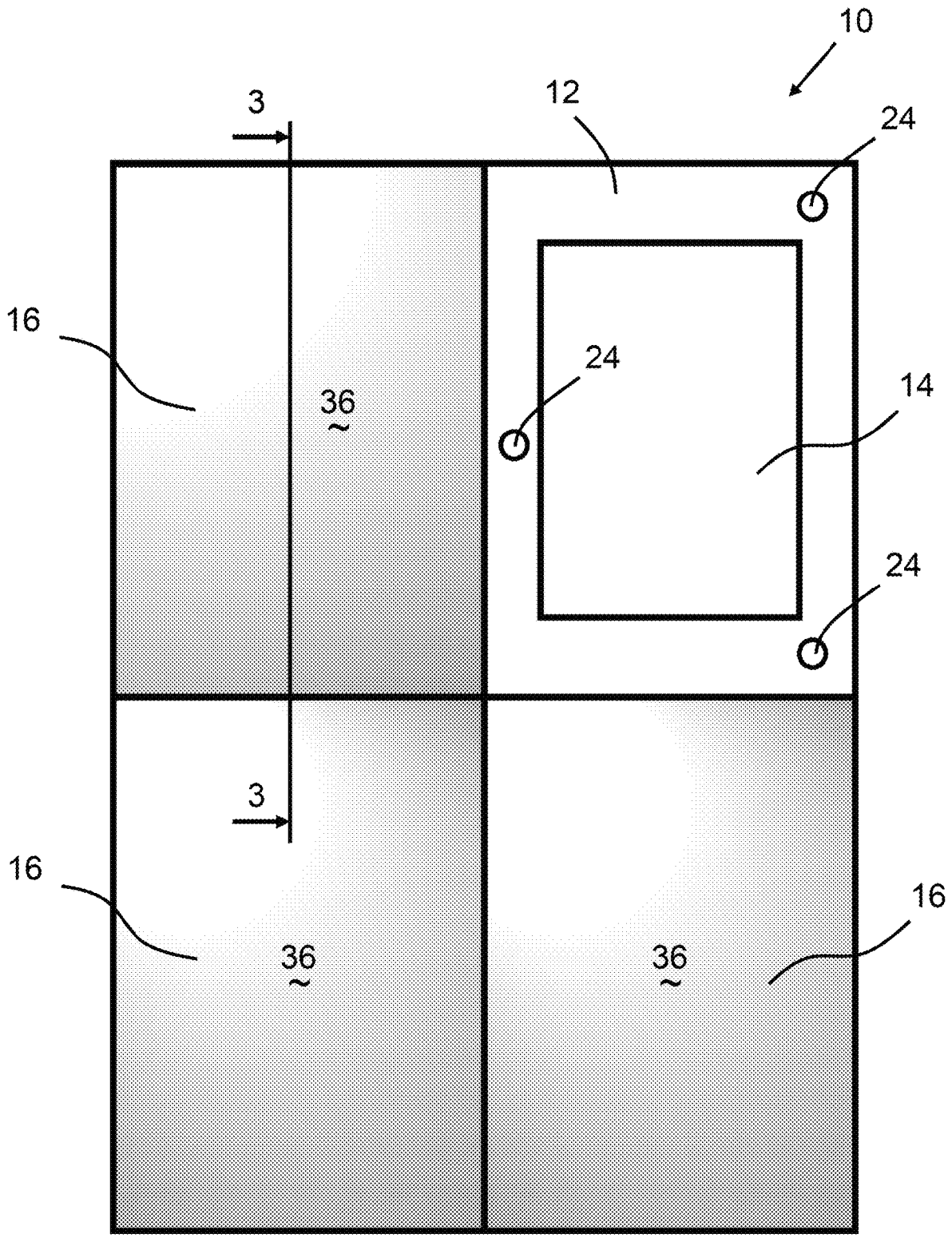
FIG. 1 illustrates a front view of a wall system in accordance with the present teachings.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The teachings herein generally relate to a wall system. The wall system may function to provide a finished surface to one or more structures. The wall system may function to replace one or more existing finished surfaces, be mounted over one or more existing finished surfaces, or both. The wall system may include a frame. The wall system may include one or more panels. The wall system may be customizable, interchangeable, or both. The wall system may be integrally formed or may include a plurality of components. The wall system may be structurally rigid. The wall system may be bendable, expandable, or both.

The wall system may be configured for a variety of industries. The industries may include commercial construction and/or renovation, consumer remodeling, aeronautical, nautical, automotive, or a combination thereof. For example, the wall system may be configured for mounting in a commercial building to existing walls. Alternatively, or additionally, the wall system may be configured to provide a finished interior surface to a cabin of an airplane.

The wall system may include a plurality of moveable and mountable components. The wall system may vary in size and shape. For example, the wall system may be customized to specific dimensions so that the wall system substantially or completely covers an existing wall surface. The wall system may be configured to form a finished surface along one or more joints. The one or more joints may be an abutment between a plurality of walls. For example, the one or more joints may be a corner of a room created by two abutting walls forming a substantially right angle (i.e., about 90 degrees). The wall system may be configured to create a finished surface over one or more walls. The wall system may be configured to create a finished surface on a ceiling. The wall system may be configured to create a finished flooring. The wall system may be configured to create a countertop.

A plurality of walls systems may be utilized to form a wall assembly. For example, a plurality of wall systems may all be mounted to an existing wall to create a substantially uniform finished surface. The plurality of wall systems may abut one another or be spaced apart a desired width. The plurality of wall systems may thus substantially, or entirely, cover the existing wall. The wall systems may abut each other along a peripheral edge so that the wall systems form a substantially coplanar surface (i.e., to look substantially like a wall). The wall systems may abut each other at any angle. The peripheral edges of the wall systems may abut one another to form an angle of about 30 degrees or more, about 60 degrees or more, or about 90 degrees or more. The peripheral edges of the wall systems may abut one another to form an angle of about 150 degrees or less, about 120 degrees or less, or about 90 degrees or less. The wall systems may form a corner, joint, or both. The wall systems may be secured on top of one another to form a stacked surface. The wall systems may be positioned at any orientation relative to each other, relative one or more surfaces or structures, or both.

The wall system may include a frame. The frame may function as a substrate for one or more panels. The frame may function as a mounting portion of the wall system that mounts to an existing surface, structure, or both. The frame may be structurally rigid to provide one or more panels a surface for attachment. The frame may be any size and shape. For example, the frame may be rectangular, oval, circular, square, triangular, trapezoidal, any other shape, or a combination thereof. The frame may vary in dimensions. For example, the frame may be sized to any desired dimensions to meet a consumer's needs. The frame may vary in thickness. The frame may have a thickness or about 5 mm or more, about 10 mm or more, or about 15 mm or more. The frame may have a thickness of about 30 mm or less, about 25 mm or less, or about 20 mm or less.

The frame may include one or more filleted edges, chamfered edges, or both. The frame may have one or more substantially flat surfaces. The flat surfaces may abut and mate with a surface of an existing wall, one or more panels of the wall system, or both. The frame may have one or more surfaces that include one or more contours, bumps, undulations, divots, recesses, cavities, or a combination thereof. The frame may include one or more peripheral edges. The peripheral edges may be flat, rounded, concave, convex, or a combination thereof. The peripheral edges may include one or more mechanical joint portions to interconnect a plurality of frames. For example, a first frame may include a male joint portion that connects to a female joint portion of a second frame so that the first frame and the second frame abut one another along their respective peripheral edge. The mechanical joint may be a dovetail joint, a lap joint, a butt joint, a biscuit joint, a tongue-and-groove joint, or a combination thereof.

The frame may be comprised of one or more materials. The frame may include a core portion and an outer portion. For example, the frame may include a core substantially covered by a laminate material. The frame may be made from natural or artificial materials. The frame may be comprised of wood, rubber, plastic, polymers, metal, or a combination thereof. For example, the frame may be a fiberboard material, such as a high-density fiberboard, medium-density fiberboard, low-density fiberboard, or a combination thereof. The fiberboard material may be covered by a laminate along one or more surfaces to create a finished surface. The frame may be flame retardant, moisture resistant, odor resistant, antimicrobial, antifungal, antibacterial, or a combination thereof. The frame may be sound absorbing, vibration dampening, or both. The frame may be formed using one or more manufacturing techniques. For example, the frame may be created by stamping, cutting, injection-molding, casting, or a combination thereof.

The frame may include one or more cutouts. The cutouts may function to decrease the weight of the frame. The cutouts may function to aid in alignment between the frame and one or more mounting structures, one or more panels of the wall system, or both. The cutouts may extend through an entire thickness of the frame or only a portion of the thickness of the frame (e.g., to form a recess). The cutouts may be positioned anywhere along the frame. The cutouts may be any size and shape. The cutouts may be one or more cutouts, two or more cutouts, or three or more cutouts. The cutouts may be six or less cutouts, five or less cutouts, or four or less cutouts. The number of cutouts may be any desired number. The cutouts may substantially reduce a weight of the frame. The cutouts may reduce the weight of the frame by about 20% or more, about 30% or more, about 40% or more, or about 50% or more. The cutouts may reduce the weight of the frame by about 90% or less, about 80% or less, about 70% or less, or about 60% or less. The cutouts may be configured and/or positioned along the frame so that one or more panels substantially or completely obscures view of the cutouts once the one or more panels are secured to the frame.

The frame may include one or more studs. The studs may function to secure one or more panels to the frame. The studs may project from a surface of the frame. The studs may be integrally formed with the frame. The studs may be secured to the frame prior to securing one or more panels to the frame. For example, the studs may be threaded into one or more holes of the frame. The studs may project at any desired angle or distance relative to the frame. The studs may be a fastener such as a bolt, screw, nail, or a combination thereof. The studs may be a dowel, rod, pin, hook, shaft, or a combination thereof. The studs may be structurally rigid. The studs may be any desired size and shape based on a given application.

The studs may be removably attached to the frame. The studs may be positioned anywhere along the frame. The studs may be positioned along a perimeter of the cutouts. The studs may extend from a surface of the frame that abuts the one or more panels when the one or more panels are secured to the frame via the studs. A plurality of studs may secure a single panel or a plurality of panels. For example, each panel may be secured to the frame by two or more studs, three or more studs, or four or more studs. Each panel may be secured to the frame by seven or less studs, six or less studs, or five or less studs.

The studs may include a friction modifier. The friction modifier may aid in insertion of the studs into one or more holes of the one or more panels. The friction modifier may be grease, oil, silicone, another lubricant, or a combination thereof. Alternatively, the studs may be free of any friction modifier. The studs may be coated to prevent corrosion, rust, degradation, or a combination thereof. The coating may be an electrophoretic paint, a galvanized coating, a powder coating, or a combination thereof.

The studs may removably secure one or more panels. The panels may function to create a finished surface of the wall system. The panels may function to obstruct view of the frame or one or more cutouts of the frame when fully assembled. The panels may be any size and shape. The panels may be square, rectangular, oval, round, triangular, trapezoidal, or a combination thereof. The panels may have dimensions greater than the frame, less than the frame, or both. For example, a single panel may have dimensions greater than the frame or a plurality of panels may be secured within the outer perimeter of a single frame. The panels may vary in thickness. The panels may have a thickness or about 5 mm or more, about 10 mm or more, or about 15 mm or more. The panels may have a thickness of about 30 mm or less, about 25 mm or less, or about 20 mm or less.

The panels may be comprised of one or more materials. The panels may include a core portion and an outer portion. For example, the panels may include a core substantially covered by a laminate material. The panels may be made from natural or artificial materials. The panels may be comprised of wood, rubber, plastic, polymers, metal, or a combination thereof. For example, the panels may be a fiberboard material, such as a high-density fiberboard, medium-density fiberboard, low-density fiberboard, or a combination thereof. The fiberboard material may be covered by a laminate along one or more surfaces to create a finished surface. The panels may be flame retardant, moisture resistant, odor resistant, antimicrobial, antifungal, antibacterial, or a combination thereof. The panels may be sound absorbing, vibration dampening, or both. The panels may be formed using one or more manufacturing techniques. For example, the panels may be created by stamping, cutting, injection-molding, casting, or a combination thereof.

The panels may include one or more filleted edges, chamfered edges, or both. The panels may have one or more substantially flat surfaces. The flat surfaces may abut and mate with a surface of an existing wall, one or more panels of the wall system, or both. The panels may have one or more surfaces that include one or more contours, bumps, undulations, divots, recesses, cavities, or a combination thereof. The panels may include one or more peripheral edges. The peripheral edges may be flat, rounded, concave, convex, or a combination thereof. The peripheral edges may include one or more mechanical joint portions to interconnect a plurality of panels. For example, a first panel may include a male joint portion that connects to a female joint portion of a second panel so that the first panel and the second panel abut one another along their respective peripheral edge. The mechanical joint may be a dovetail joint, a lap joint, a butt joint, a biscuit joint, a tongue-and-groove joint, or a combination thereof.

The frame system may include a plurality of panels. The plurality of panels may be substantially uniform to create a substantially uniform finished surface when secured to the frame. Alternatively, the plurality of panels may vary in design to create a pattern when secured to the frame. The plurality of panels may be removably secured to the frame. The plurality of panels may be removed free of damage, distortion, fracturing, or a combination thereof of the panels, the frame, or both. The plurality of panels may be interchangeable. The plurality of panels may allow for low-maintenance replacement by swapping out one panel for another panel. For example, a damages panel may be easily replaced by removing the damages panel secured to the frame and securing a new panel to the frame in its place. By allowing for panel replacement, a consumer would not be required to replace an entire panel system.

The panels may have one or more exposed surfaces. The one or more exposed surfaces may function as the finished surface of the wall system. The exposed surfaces may be a surface visible once the panels are secured to the frame. The exposed surfaces may include a surface finish. The surface finish may be a laminate, polypropylene coating, paint coating, gloss finish, stain, or a combination thereof.

The exposed surface may oppose an abutting surface of the panel. The abutting surface may function as an interface between panels and the frame. The abutting surface may be free of any surface finish. The abutting surface may be free of a laminate. The abutting surface may be positioned substantially flush to a surface of the frame. The abutting surface may be substantially parallel to the exposed surfaces. The abutting surface may be substantially perpendicular to the exposed surfaces.

The abutting surface may include one or more holes. The holes may function to receive a clip, the one or more studs, or both. The holes may receive the studs to secure the panel to the frame. The holes may be any size and shape to receive the clip, the one or more studs, or both. The holes may extend through a portion of the thickness of the panels or may extend through the entire thickness of the panels. The holes may form a cavity in the panel. The holes may have one or more chamfered or rounded edges. The holes may be uniform in size and shape, or the holes may be different in size and shape between one another.

The holes may receive a clip. The clip may function to engage the studs to secure the panels to the frame. The clip may function to removably secure the panels to the frame. The clip may be at least partially inserted into the holes of the panels. The clip may have a portion having a diameter substantially similar to a diameter of the holes so that a press-fit condition is formed between the clip and holes when the clip is inserted into a hole. The clip may include one or more threads, one or more teeth, one or more projections, or a combination thereof to engage the hole. The clip may abut the abutting surface of the panels. The clip may include one or more fingers, one or more teeth, one or more arms, one or more hooks, or a combination thereof that engage the studs. The clip may freely receive the studs but require additional force to release the studs. An insertion force may be about 2 kilograms or more, about 4 kilograms or more, or about 8 kilograms or more. An insertion force may be about 16 kilograms or less, about 12 kilograms or less, or about 10 kilograms or less. A removal force may be about 8 kilograms or more, about 12 kilograms or more, or about 16 kilograms or more. The removal force may be about 28 kilograms or less, about 24 kilograms or less, or about 20 kilograms or less.

The clip may include an inner casing, an outer casing, or both. For example, the clip may include a base member that is inserted into a hole of a panel, the frame, a wall, or a combination thereof. Once the base member is secured, an inner clip may be connected to the base member to create a fastener system. For example, the inner clip may be press-fit or threaded into the base member of the fastener system. Advantageously, it is envisioned that such interconnection of the fastener system may allow for micro-adjustments along the wall system to ensure that each frame, each panel, or a combination thereof rests flush again the wall to create the best visual assembly.

It should be noted that the studs, the clips, or both may be secured to any of the components within the wall system. For example, the clips may be located on the frame and the associated studs may be secured to the panels, or vice versal. Additionally, any of the fasteners systems described herein may also be utilized to secure the frame to a wall.

The wall system may be secured to an existing wall. The wall may function to support the wall system. The wall may be any existing wall or structure. For example, the wall may be a gypsum board (e.g., drywall), particle board, wood panel, concrete slab, plaster, sheet metal, or a combination thereof. The wall may be an existing finished interior or exterior wall of a building or vehicle. The wall system may be secured to the wall to alter the finished look of the existing wall.

The wall system may be secured to the wall via one or more fasteners, one or more adhesives, or both. The one or more fasteners may be a screw, nail, bolt, anchor, or a combination thereof. The one or more fasteners, one or more adhesives, or both may secure all or a part of the wall system to the wall. For example, the fasteners, adhesives, or both may secure the frame to the wall so that the panels remain removably attached to the frame.

The wall system may include one or more shims. The shims may function to space apart the wall system and the wall. The shims may function to level or adjust a pitch of the wall system relative to the wall. The shims may be positioned between the frame and the wall. For example, one or more fasteners may extend through the frame and the shims into the wall so that the shims remain in place once the wall system is secured to the wall. The shims may be positioned anywhere between the wall and the wall system. The shims may be secured to the wall system prior to securing the wall system to the wall. For example, the shims may adhere to a surface of the frame that abuts the wall.

The shims may be adjusted to align the frame of the wall system with a baseboard. The baseboard may be positioned and secured along a bottom edge of the wall. The frame may be positioned substantially coplanar with the baseboard. The frame may form a desired angle with the baseboard. For example, the frame and the baseboard may create an angle of about 30 degrees or more, about 45 degrees or more, or about 60 degrees or more. The frame and the baseboard may create an angle of about 90 degrees or less, about 75 degrees or less, or about 60 degrees or less. The wall system and the baseboard may abut one another, may be secured to one another, or both. The wall system may be spaced apart from the baseboard by a desired length.

The panels of the wall system may be aligned with a base tile secured to the baseboard. The base tiles may be fastened, adhered, or both to the baseboard. The base tiles and the panels may be substantially coplanar. A surface of the base tiles and at least one of the exposed surfaces of the panels may be substantially flush to create a substantially uniform surface.

Turning now to the figures, FIG. 1 illustrates a front view of a wall system 10. The wall system 10 includes a frame 12 having a plurality of cutouts 14. Each cutout 14 abuts a panel 16 secured to the frame 12 by a plurality of fasteners 24. Each panel 16 includes an abutting surface that abuts the frame 12 and one or more exposed surfaces 36. The exposed surfaces 36 may include a finished surface such as a design, finishing paint, or other type of finishing product.

Figure 2:
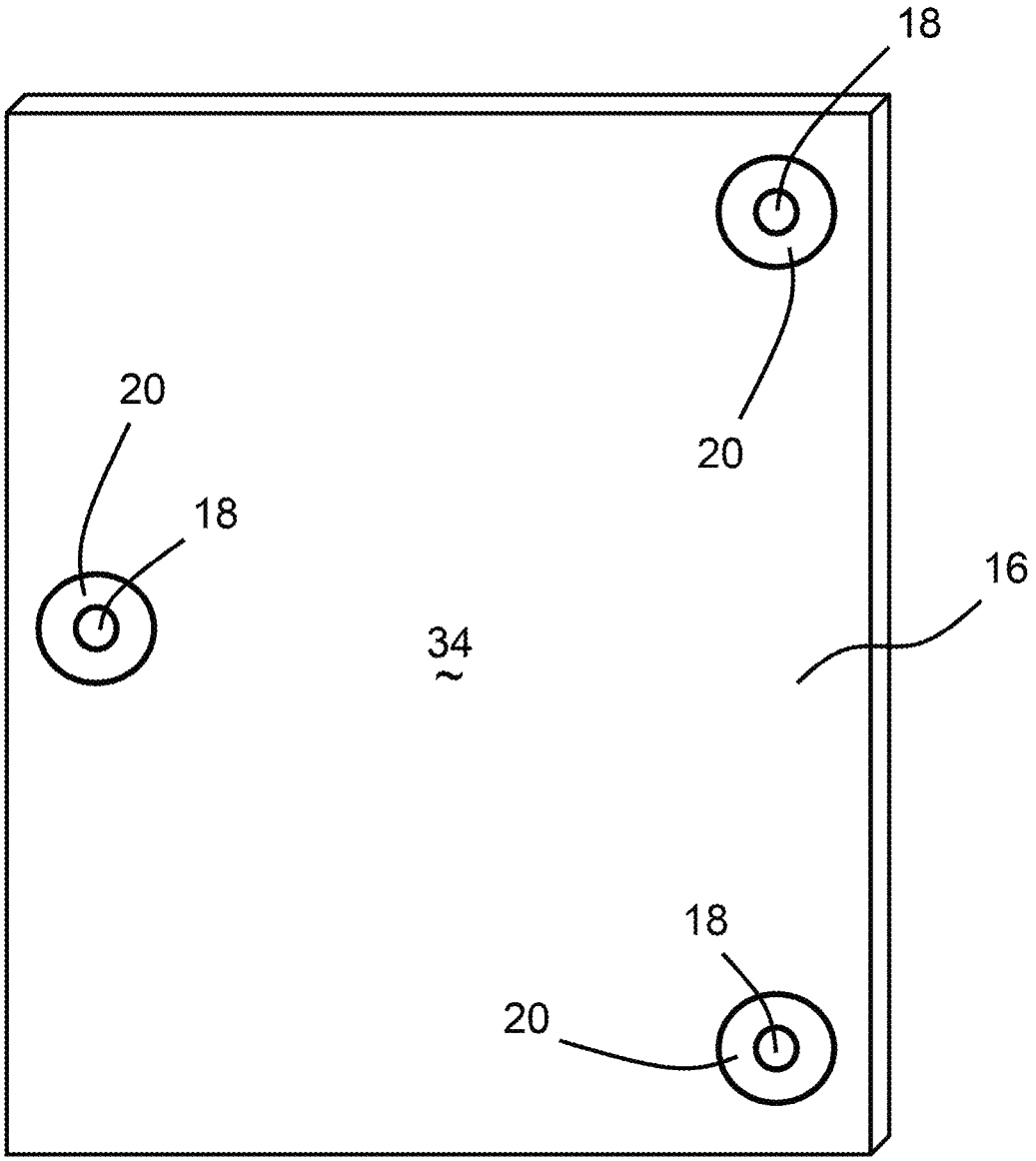
FIG. 2 illustrates an abutting surface of a panel of a wall system in accordance with the present teachings.

FIG. 2 illustrates an abutting surface 34 of a panel 16. The panel 16 includes a plurality of holes 18. Each hole 18 includes a clip 20 at least partially inserted into the hole 18. As shown in FIG. 1, the fasteners projecting from the frame are inserted into the holes 18 and engage the clips 20 so that the panel 16 is removably secured to the frame and the abutting surface 34 abuts an outer surface of the frame.

Figure 3:
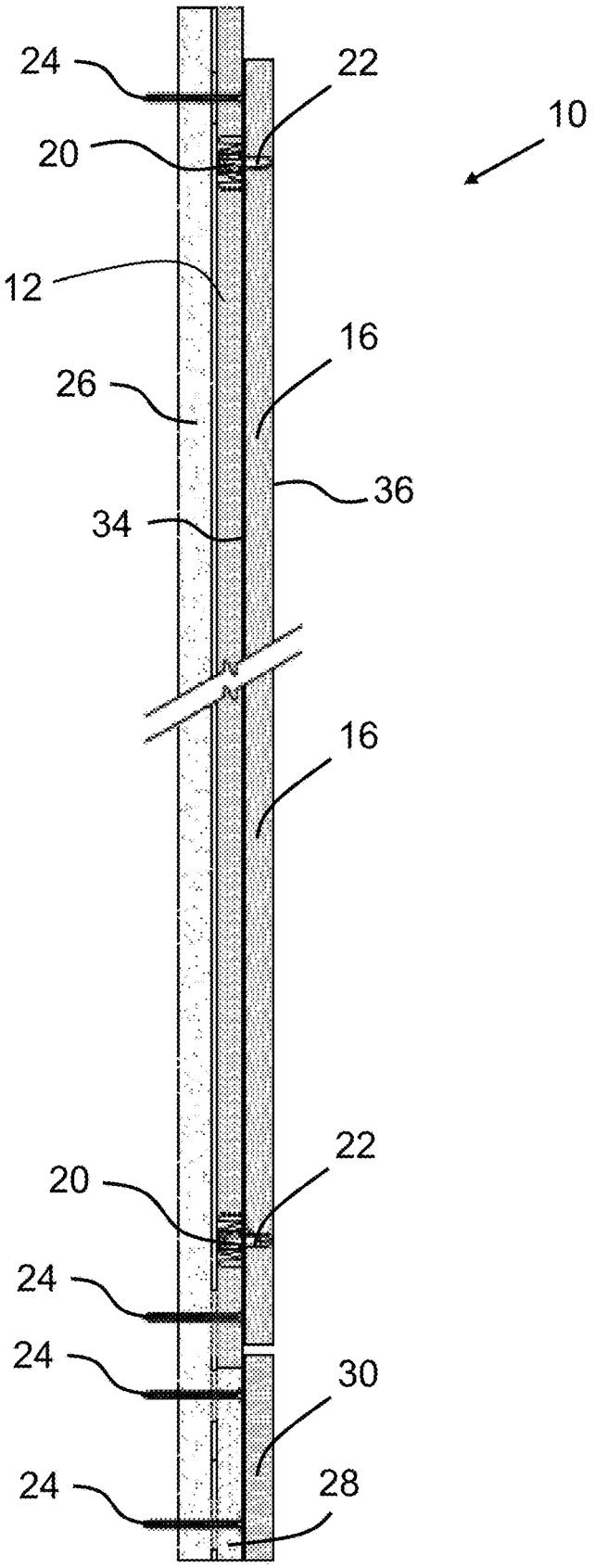
FIG. 3 illustrates cross-sectional view 3-3 of the wall system of FIG. 1.

FIG. 3 is cross-sectional view 3-3 of the wall system 10 of FIG. 1 mounted to a wall 26. The wall system 10 includes a frame 12 and a baseboard 28 secured to the wall 26 via a plurality of fasteners 24, adhesives (not shown), or both. The frame 12 and the wall 26 may be spaced apart via one or more shims 32 to create a flush surface between the frame 12 and a baseboard 28. A plurality of panels 16 are secured to the frame 12 by a plurality of studs 22. The studs 22 project from the panels 16 and extend into clips 20 of the frame 12 to removably secure the panels 16 to the frame 12. As illustrated, each panel 16 abuts the frame 12 along an abutting surface 34 so that one or more exposed surfaces 36 of the panels 16 are exposed to create a finished surface along the wall 26. Additionally, the exposed surface may be flush with a base tile 30 secured to the baseboard 28 by one or more adhesives (not shown).

Figure 4:
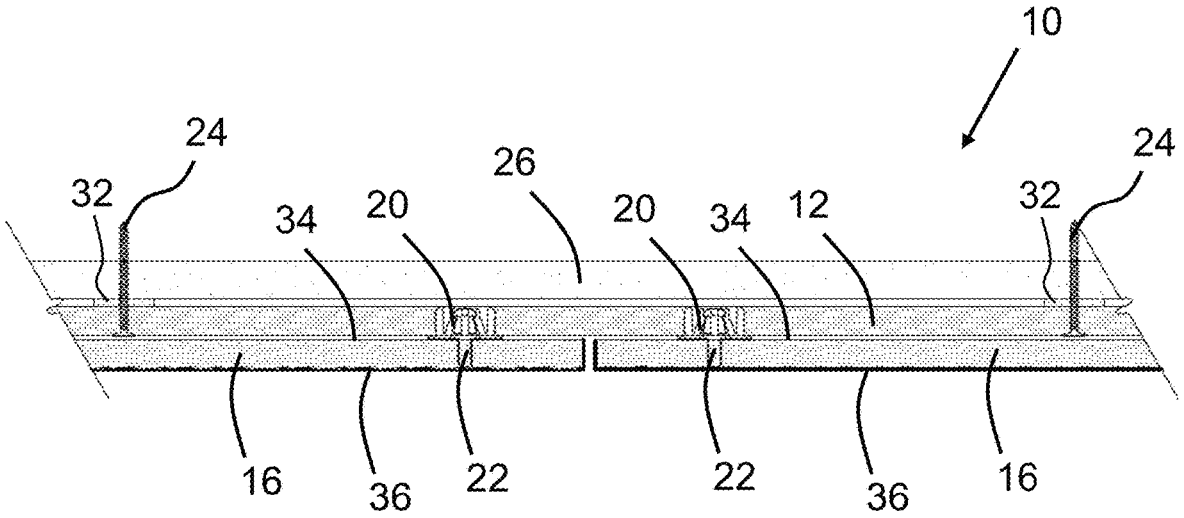
FIG. 4 illustrates a cross-sectional view of a wall system having abutting panels in accordance with the present teachings.

FIG. 4 illustrates a cross-sectional view of a wall system 10. The wall system 10 includes a frame 12 secured to a wall 26 via a plurality of fasteners 24. The frame 12 and the wall 26 may be spaced apart via one or more shims 32. A plurality of panels 16 are secured to the frame 12 by a plurality of studs 22. The studs 22 project from the panels 16 and extend into clips 20 of the frame 12 to removably secure the panels 16 to the frame 12. As illustrated, each panel 16 abuts the frame 12 along an abutting surface 34 so that one or more exposed surfaces 36 of the panels 16 are exposed to create a finished surface along the wall 26.

Figure 5:
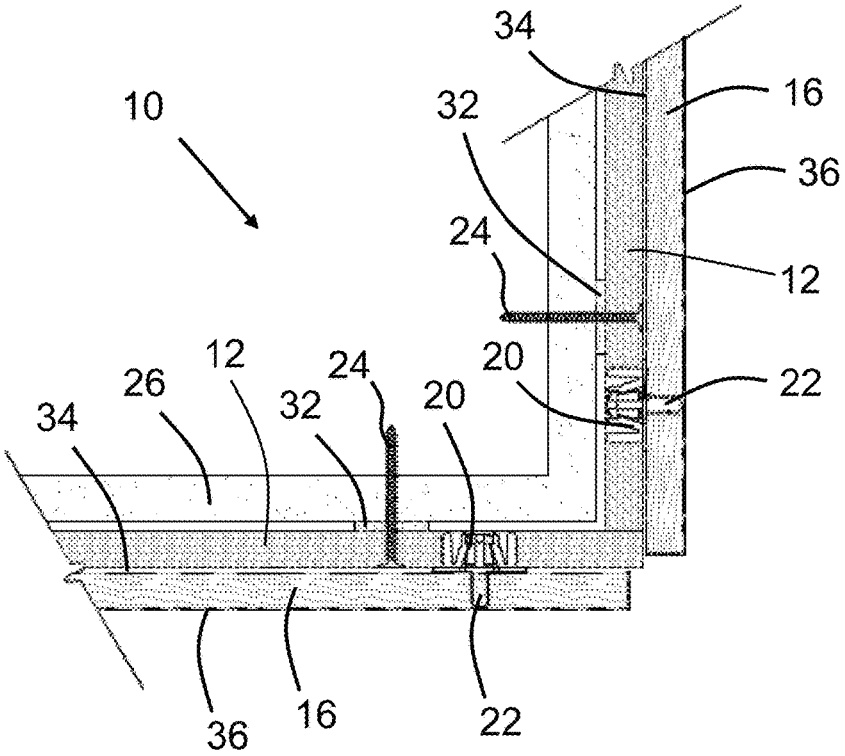
FIG. 5 illustrates a cross-sectional view of a wall system for an abutting corner of a wall in accordance with the present teachings.

FIG. 5 illustrates a cross-sectional view of a wall system 10 for an abutting corner of a wall 26. The wall system 10 includes a plurality of adjacent frames 12 secured to a wall 26 via a plurality of fasteners 24. The frames 12 and the wall 26 may be spaced apart via one or more shims 32. A plurality of panels 16 are secured to the frames 12 by a plurality of studs 22. The studs 22 project from the panels 16 and extend into clips 20 of the frames 12 to removably secure the panels 16 to the frames 12. As illustrated, each panel 16 abuts the frames 12 along an abutting surface 34 so that one or more exposed surfaces 36 of the panels 16 are exposed to create a finished surface along the wall 26.

Figure 6A:
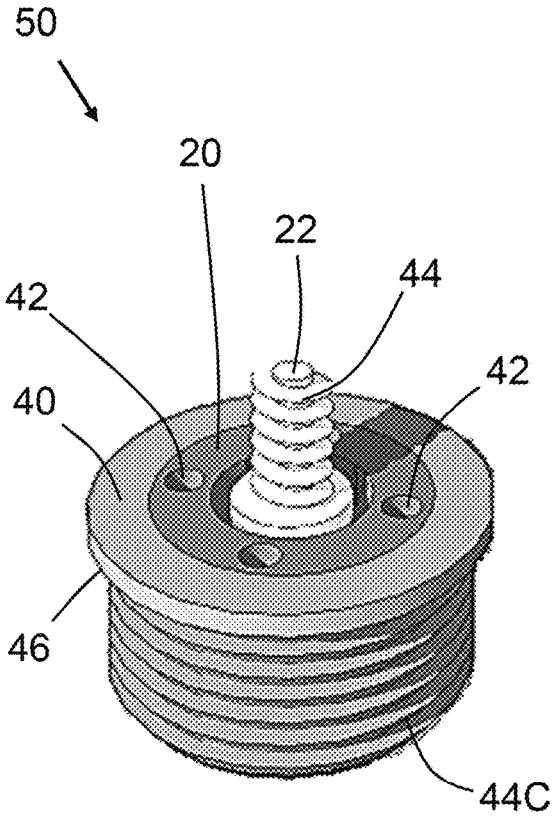
FIG. 6A illustrates a perspective view of a fastener system utilized in a wall system described herein.

FIG. 6A is a perspective view of a fastener system 50. The fastener system 50 may be used to secure the panels of the wall system to the frame, the frame to a wall, or both. The fastener system 50 may include a stud 22. The stud 22 may be threaded directly into a panel, frame, or both using an external threading 44 of the stud 22. Therefore, the stud 22 may be fixedly secured to at least the panel or the frame to prevent removal of the stud 22. However, it should be noted that the stud 22 may also be removable to modify configurations of the wall system by unscrewing the stud 22, yet the stud 22 may still prevent unwanted disconnection based upon a pull force.

The stud 22 may secure a panel to the frame, the frame to a wall, or both by inserting a head 38 of the stud 22 into a clip 20 of the fastener system 50. The clip 20 may create a friction fit with the stud 22, thereby preventing unwanted removal of the stud 22 from the clip 20 below a desired force threshold. To secure the clip 20 to a mating component (e.g., the stud 22 is located in a panel and the clip 20 is mounted to a frame of the wall system), a base member 40 is threaded, pushed, or otherwise engages the mating component via outer threading 44C. The clip 20 is then threaded into the base member 40 to secure the clip 20 in place. Advantageously, the clip 20 may be adjusted within the base member 40 using one or more eyeholes located along an outer surface of the clip 20. In doing so, the clip 20 allows for adjustments of the stud 22 positioning, thereby allowing the wall system 10 to be adjusted to remain flush between mating surfaces. For example, a contoured or imperfect wall may require different adjustments at different clips 20 an adjustment possible with the fastener system 50 described herein. It should be noted that while an upper surface of the clip 20 is shown substantially flush with an upper surface of a flange 46 of the base member 40, the clip 20 may be adjusted to protrude from the base member 40, be recessed from the base member 40, or both. For example, the clip 20 may also include a flange that abuts the flange 46 of the base member 40 to ensure proper positioning of the clip 20 relative to the base member 40.

Figure 6B:
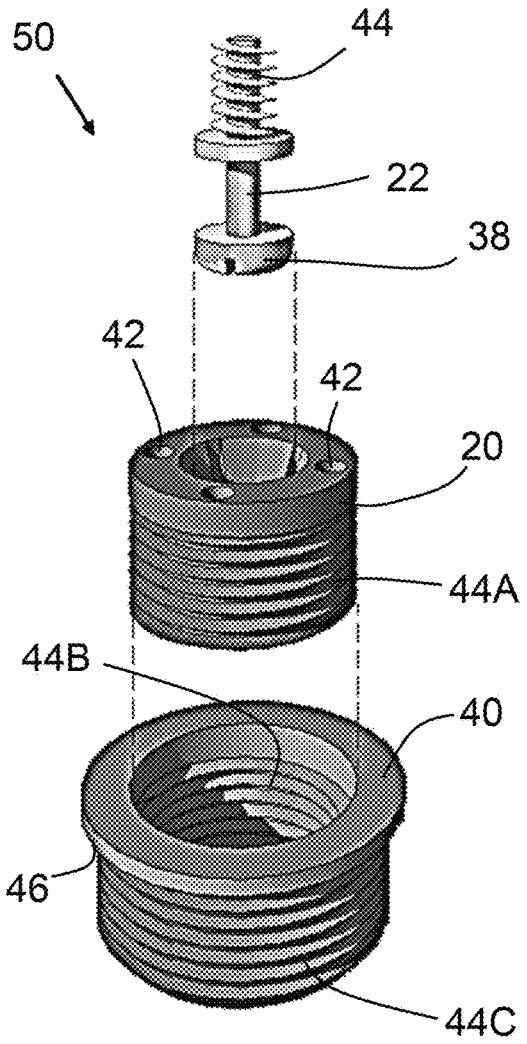
FIG. 6B illustrates an exploded view of the fastener system of FIG. 6A.

FIG. 6B illustrates an exploded view of the fastener system 50 shown in FIG. 6A. As illustrated, the base member 40 is substantially cylindrical and includes a hollowed inner portion. The base member 40 further includes an outer threading 44C or rigid surface to engage a hole within the frame, a panel, or both. The base member 40 may be inserted into a hole of the frame, the panel, or both until the flange 46 abuts a surface of the frame, the panel, or both.

Before or after insertion of the base member 40, the clip 20 may be inserted into the base member 40. The clip 20 may include outer threading 44A that engages inner threading 44B of the base member 40. Beneficially, the threading 44 engagement may allow for increment adjustment of the position of the clip 20 relative to the base member 40. To adjust the position of the clip 20, a tool may be inserted into one or more eyeholes 42 of the clip 20, thereby allowing an operator to rotate the clip 20 relative to the base member 40. Once the clip 20 is positioned, a head 38 of the stud 22, which is secured to a panel or other mating element, is inserted into the clip 20 to create a press-fit condition.

ELEMENT LIST

10 Wall System
12 Frame
14 Cutout
16 Panel
18 Hole
20 Clip
22 Stud
24 Fastener
26 Wall
28 Baseboard
30 Base Tile
32 Shim
34 Abutting Surface
36 Exposed Surface
38 Head
40 Base Member
42 Eyehole
44 Threading
44A Outer Threading of the Clip
44B Inner Threading of the Base Member
44C Outer Threading of the Base Member
46 Flange
50 Fastener System The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

The disclosures of all articles and references, including patent applications and publications, are incorporated by reference for all purposes. Other combinations are also possible as will be gleaned from the following claims, which are also hereby incorporated by reference into this written description.

What is claimed is:

1. A wall system comprising:

(a) a frame having a clip at least partially inserted into a hole of the frame; and (b) panel removably attached to the frame;

wherein the panel is positioned over a cutout of the frame; and wherein the clip includes a base portion inserted into the hole and an inner clip threaded into the base portion so that a stud projecting from the panel is inserted into the inner clip to secure the panel to the frame.

2. The wall system according to claim 1, wherein a perimeter of the panel is greater than a perimeter of the cutout so that the panel completely covers the cutout.

3. The wall system according to claim 1, wherein the stud projects from an abutting surface of the panel.

4. The wall system according to claim 3, wherein the abutting surface of the panel abuts a surface of the frame when the panel is secured frame.

5. The wall system according to claim 1, wherein the frame is configured to be substantially coplanar with a baseboard secured to a wall.

6. The wall system according to claim 1, wherein the panel is configured to be coplanar with a base tile secured to a baseboard of a wall.

7. The wall system according to claim 1, wherein the panel is a medium-density fiberboard.

8. The wall system according to claim 1, wherein the panel includes an exposed laminated surface to form a finished surface.

9. The wall system according to claim 1, wherein the panel is interchangeable with one or more additional panels.

10. The wall system according to claim 1, wherein a plurality of panels are secured to the frame, and an exposed surface of the plurality of panels creates a substantially uniform surface finish.

11. The wall system according to claim 1, wherein the frame is a medium-density fiberboard.

12. The wall system according to claim 10, wherein the plurality of panels once attached to the frame abut one another, are spaced apart by a desired width, or both.

13. The wall system according to claim 6, wherein the wall is a gypsum board.

14. The wall system according to claim 10, wherein the plurality of panels are interchangeable free of any distortion or damage to the plurality of panels.

15. The wall system according to claim 1, wherein the panel is 10 mm to 15 mm thick.

16. The wall system according to claim 1, wherein the frame is 10 mm to 15 mm thick.

17. The wall system according to claim 1, wherein the stud is inserted into the clip by a force of about 10 pounds and is released from the clip by a force of about 25 pounds.

18. A plurality of wall systems according to claim 1, wherein the plurality of walls systems are secured to a wall and abut one another to form a substantially uniform finished surface of the wall.

* * * * *